United States Patent [19]

Blomqvist et al.

[11] Patent Number: 4,688,725

[45] Date of Patent: Aug. 25, 1987

[54] METHOD FOR REGULATION OF GRINDING PROCESS IN A POCKET GRINDER

[75] Inventors: Seppo Blomqvist, Tampere; Heikki U. Liimatainen, Inkeroinen; Kaj Sundström, Tampere; Risto T. Vahteri, Kouvola, all of Finland

[73] Assignee: Oy Tampella Ab, Tampere, Finland

[21] Appl. No.: 811,536

[22] Filed: Dec. 20, 1985

[30] Foreign Application Priority Data

Jan. 25, 1985 [FI] Finland ..... 850338

[51] Int. Cl.[4] ..... B02C 23/18

[52] U.S. Cl. ..... 241/28; 241/20; 241/34; 241/282

[58] Field of Search ..... 241/28, 30, 33, 34, 241/282

[56] References Cited

U.S. PATENT DOCUMENTS 3,690,568 9/1972 Alexander ..... 241/34 X
3,693,891 9/1972 Remmer ..... 241/34 X
3,776,476 12/1973 Sandblom et al. ..... 241/34
4,515,318 5/1985 Savonjousi ..... 241/34 X
4,541,571 9/1985 Karna et al. ..... 241/34 X

*Primary Examiner*—Howard N. Goldberg
*Assistant Examiner*—Taylor J. Ross
*Attorney, Agent, or Firm*—Ladas & Parry

[57] ABSTRACT

A method of regulating a grinding process in a pocket grinder pressing a wood batch in at least one pocket against a rotating grindstone with a grinding plate movable in the pocket calculates the apparent pulp quantity produced at measuring points at fixed intervals of the grinding stroke and changes in the wood batch density which occur during the grinding stroke. The value thus calculated is compared with a target value for the pulp quantity to be produced and the grinding process regulated thereby to reach the target value. To make the pulp quantity produced as even as possible, the calculated value of the apparent pulp quantity produced is corrected in relation to the hydraulic pressure used during the grinding stroke.

2 Claims, 9 Drawing Figures

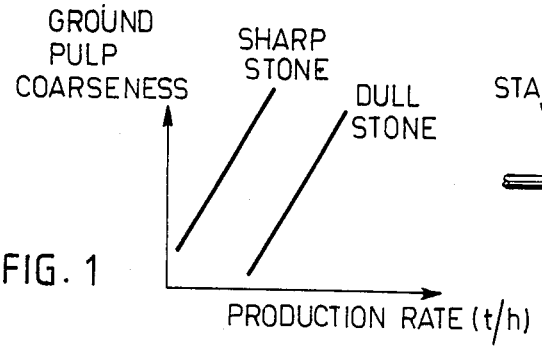
FIG. 1
FIG. 3
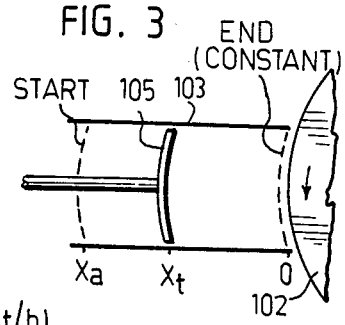
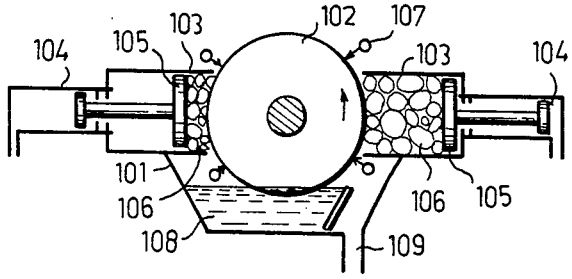
FIG. 2
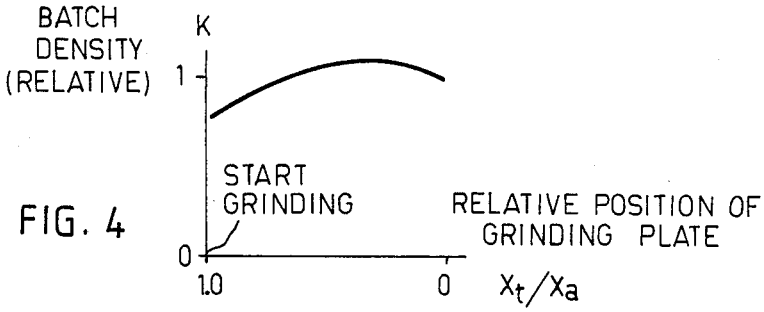
FIG. 4
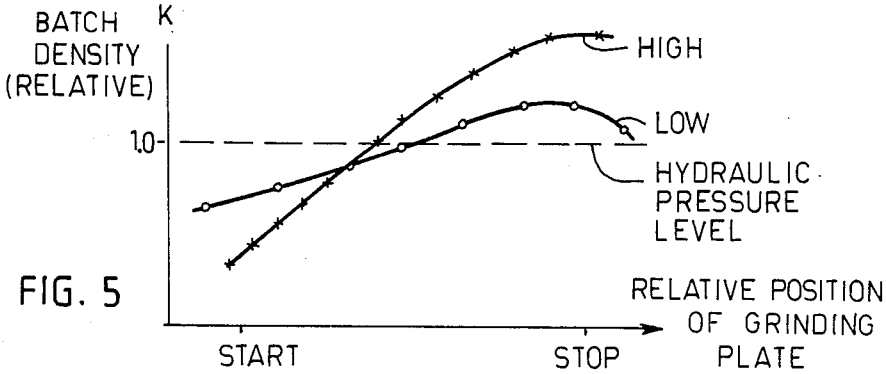
FIG. 5

FIG. 6
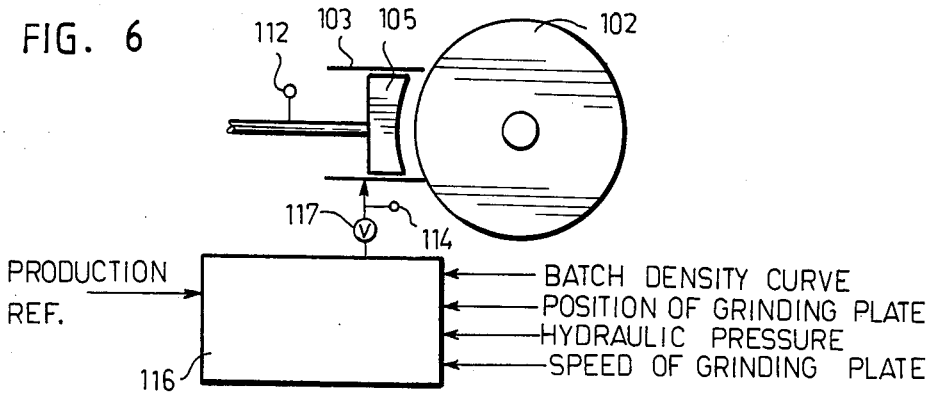
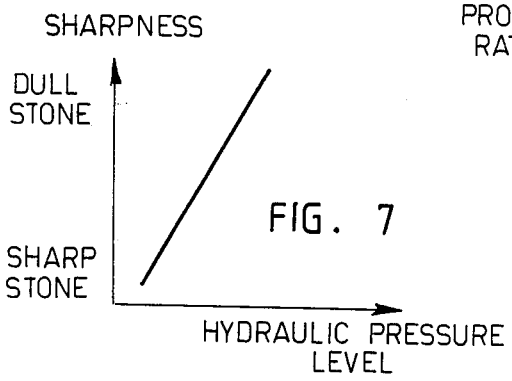
FIG. 7
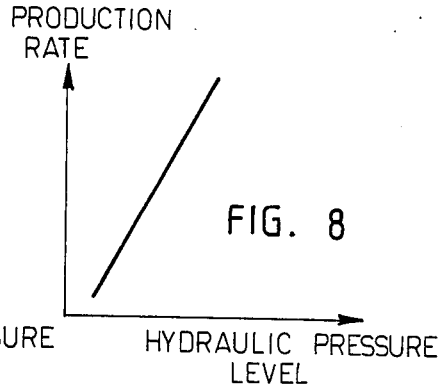
FIG. 8
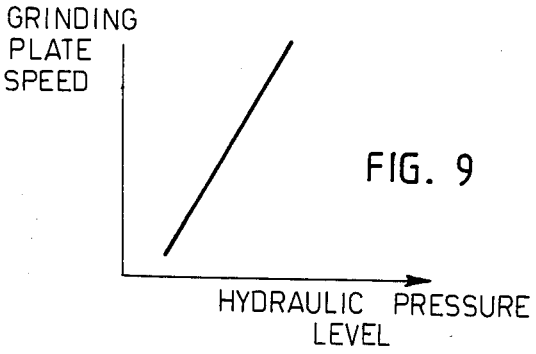
FIG. 9

METHOD FOR REGULATION OF GRINDING PROCESS IN A POCKET GRINDER

The invention relates to a method of regulating the grinding process of a pocket grinder. In the method a wood batch in at least one pocket is pressed against a rotating grindstone by a grinding plate movable in the pocket. The apparent quantity of wood pulp so produced is calculated at measuring points at fixed intervals of the grinding-stroke movement of the grinding plate, the calculation also considering changes in the density of the wood batch which occur during the grinding stroke to successive masuring points. The apparent pulp quantity thus calculated for each measuring point is compared with a target pulp quantity for the measuring point and the grinding process regulated to reach the target value for the next measuring point.

Mechanically-produced wood pulp is generally manufactured in so-called pocket grinders, where wood batches in the pockets are pressed against a rotating grindstone by a load cylinder and a grinding plate. To provide necessary cooling and lubrication and to transport the pulp away, the grindstone is sprayed with water.

It is generally known that the mechanical manufacture of pulp is unstable for many occasionally-varying factors. Such factors are, e.g., variations in the quality, size and moisture of the wood; the cleanliness of the stone surface; the quality of the stone and its surface pattern, i.e. a pattern cut into its surface; the abrasion of the stone surface, the power pressing the wood against the stone, etc. They result in, e.g., variations in the consistency, quality and fineness of the pulp. (A so-called CSF value has conventionally been used as a measure of pulp fineness. It also correlates well with many quality properties of the pulp.)

Most of the factors mentioned above can be maintained substantially constant only over short time intervals. Accordingly, known pocket grinder regulating techniques hold some, selected factors constant, for instance the motor output or the rate of movement of the grinding plate are made constant by regulating the hydraulic pressure. Then the true rate of production, i.e. the pulp quantity produced per time unit, varies because, as has been proved, the density of a wood batch changes during a grinding stroke. This question is handled in the Finnish Published Specification No. 64,666 and corresponding U.S. Pat. No. 4,541,571.

The purpose of the invention is to regulate the rate of production, i.e. the pulp quantity produced per time unit, so that the target figure is reached for reasons and in a manner presented later.

A change in the pulp quantity produced influences the CSF value of the pulp. When the pulp quantity produced is increased, the CSF value increases, and when the pulp quantity produced is decreased, the CSF value decreases. These changes are shown in principle in FIG. 1. (FIG. 1 also shows the situation with different constant sharpnesses of the stone.) The changes are a consequence of the influence of the friction between the grindstone and the wood to be ground on the lignin of the wood. When the pulp quantity produced is increased, correspondingly increased friction between the wood and the stone heats the wood more, whereby the lignin gets softer than before and the fibres get loose easier and are thus higher and longer with the result that the CSF value increases. A decrease of the pulp quantity produced has an opposite effect.

As we can see from the above, the variations in the pulp quantity produced, i.e. in the rate of production, show in corresponding variations in the pulp quality. Therefore, it is necessary in practice to mix pulp from different grinding machines, which grind at different rates due to a different sharpness and abrasion of grindstones, to make the CSF value constant and to start grinding at different grinding machines according to the need of production. Therefore, it is very important to minimize the unstableness of the process and the resultant variation in the pulp quality (and thus also in the paper quality therefrom) by regulating the true pulp quantity produced.

Typical ways known up till now to regulate a pocket grinder have been pressure control, power control, speed control and control of the specific consumption of energy.

By means of pressure control, it is intended to keep the hydraulic pressure influencing the load cylinder of the grinding plate constant during the whole grinding procedure. By means of power control again, it is intended to keep the rotational power of the grindstone constant. By means of speed control, it is intended to keep the advancing speed of the grinding plate constant. A traditional weakness of power and pressure control consists of big variations in freeness and thus also in quality of the pulp. A traditional weakness of speed control consists of big variations in power and in the true pulp quantity produced, which variations lead to considerable variations in CSF values.

When regulating the grinding process to make the specific consumption of energy constant, the known mutual dependence between the CSF value of the ground pulp and the specific consumption of energy is applied to the regulation. The result of the regulation has been substantially improved by the method of the above-noted Finnish Published Specification No. 64 666 which takes into consideration the average and normalized densification of the wood batch to be ground during a grinding stroke. An extremely even CSF result is achieved in principle, but if the true batch densification and the calculated one do not entirely correspond to each other at the regulation moment in question, a sufficient pulp quantity, i.e. a sufficient rate of production, is not always reached.

The purpose of the invention is to provide a method for regulation of a grinding process, which method does not show the disadvantages of the prior art. This has been achieved by the method of the invention, which is characterized in that the calculated value of the apparent pulp quantity produced is corrected in relation to the hydraulic pressure used during the grinding stroke.

The invention is based on the realization that the densification of a wood batch during a grinding stroke, which is illustrated by a so-called batch density curve or a batch density function, is dependent on the position of the grinding plate and also on the hydraulic pressure used, i.e. on the force by which the grinding plate is pressed against the wood.

The basic realization of the invention is to calculate the sharpness of the batch density curve on the basis of the hydraulic pressure used and thereafter to use the curve obtained in a known manner to achieve the target value for the pulp quantity produced. The target value can be a constant, for example. The hydraulic pressure to be used at the calculation can be defined, for example, directly by an average level of hydraulic pressure or, alternatively, indirectly, starting with factors on the basis of which the hydraulic pressure or the level of hydraulic pressure is determined, like the sharpness of the stone, the target values for the pulp quantity produced etc.

The invention is described in the following referring to the drawings enclosed, where FIG. 1 shows ground pulp coarseness as a function of production rate for sharp and dull stones, FIG. 2 shows schematically a grinder in connection with which the method of the invention can be applied, FIG. 3 shows schematically the measurement of the advance of a grinding plate, FIG. 4 shows the batch density coefficient as a function of the relative position of the grinding plate, FIG. 5 shows the dependence of the batch density on the position of the grinding plate and on the level of hydraulic pressure, FIG. 6 shows an embodiment of the invention in principle, FIG. 7 shows the stone sharpness as a function of the average level of hydraulic pressure at a constant pulp quantity produced, FIG. 8 shows the pulp quantity produced and the grinder output as a function of the average level of hydraulic pressure and FIG. 9 shows the speed of the grinding plate as a function of the average level of hydraulic pressure.

The grinder shown in FIG. 2 of the drawing and being of a type preferably functioning under continuous overpressure comprises a frame 101, a grindstone 102 rotatably journalled on the frame, on the opposite sides of which grindstone there are two pockets 103. Both pockets are provided with a grinding plate 105, which is movable by a hydraulic cylinder 104. Above both pockets, it is possible to arrange a vertical feeding pocket for a wood batch 106 to be fed into the pocket. The feeding pocket is not visible in FIG. 2. Spray water is led to the grindstone through a nozzle 107. Below the grindstone there is a trough 108 for ground pulp stock and from the trough an outlet pipe 109 leads to a destination for further processing.

The begin with, a situation will be observed, when only one of the pockets is grinding. The pulp quantity M produced is equal to the pocket volume displaced by the grinding plate multiplied by the density of the wood batch in the pocket. Consequently during the observation period t, $$M_t = A \times X_t \times D_w \times K_t \quad \text{(I)}$$

where

A = cross-sectional area of pocket $X_t$ = advance of grinding plate during period t $D_w$ = average density of wood batch in pocket during grinding $K_t$ = correction coefficient of wood batch density, i.e. batch density coefficient, depending on the position of the grinding plate and on the hydraulic pressure used during the grinding stroke.

The advance of the grinding plate can be shown by means of a relative position. FIG. 3 shows the advance of the grinding plate during grinding in principle. The size of the wood batch varies e.g. because the shapes of separate trunks and their arrangement in the feeding pocket in the filling phase vary. When the grinding plate is pressed against the wood at the beginning of a grinding stroke, the varying size of wood batches varies the initial position $X_a$ of the grinding plate. This position can be measured e.g. by means of a pulse sensor. The final position of the grinding plate is instead always the same. Therefore, it can be considered as a zero point which the position of the grinding plate is compared with. The average position $X_t$ of the grinding plate is determined in the same way during the observation period and the average relative position $X_{st}$ of the grinding plate is calculated $$X_{st} = (X_t / X_a)$$

The average position $X_t$ of the grinding plate can be determined e.g. by measuring the position of the grinding plate in the middle of the observation period. Alternatively, the position of the grinding plate can be measured in the beginning and at the end of the observation period and the average between them can be calculated. If desired, the position of the grinding plate can be measured at several points and an exact average position can be calculated for the grinding plate by various mathematical methods.

FIG. 4 shows an example of the dependence of the relative batch density, i.e. the batch density coefficient K, on the relative position of the grinding plate and from the curve, a batch density coefficient $K_t$ corresponding to the relative position of the grinding plate during each observation period t is obtained. The batch density coefficient can, of course, be expressed in any way which is proportional to the position and movement of the grinding plate and which gives the value of the coefficient with an accuracy sufficient in practice. Then, the absolute position of the grinding plate in the pocket, the advance of the grinding plate in the pocket after the grinding stroke has begun etc. can be used as a value of comparison.

Consequently, to provide a curve according to FIG. 4, the position of the grinding plate shall be measured at sufficiently many points and the true pulp quantity produced shall be calculated at these measuring points (pulp quantity = flow rate × consistency). The apparent pulp quantity produced shall be calculated on the basis of the cross-section A of the pocket, the average density $D_w$ of the wood batch and the average advance of the grinding plate. A value based on experience, $D_w = 294$ kg/m$^3$, can be used as the average density. On the basis of the information above, it is possible to form the batch density curve mentioned above, which is shown in FIG. 4 as an example. On the vertical axis is the relation between the true pulp quantity produced and the apparent pulp quantity produced and on the horizontal axis is the relative position of the grinding plate. It is evident that, in practice, it is necessary to find a final form based on wide practical experiments for the graph of the batch density. When forming the curve, the different values shall naturally be made commensurable and if it is necessary, an estimation on the basis of the test results shall be used, as stated in the Finnish Published Specification No. 64 666.

According to the invention, it has been noticed that the batch density curve formed in the manner described above depends on the position of the grinding plate, but also on the hydraulic pressure used during the grinding stroke. In FIG. 5, the shape of the batch density curve is shown, in principal, for two different levels of hydraulic pressure. As seen from FIG. 5, the curve on the high level of hydraulic pressure is much sharper than the curve on the low pressure level. For this reason, different values are obtained for the correction coefficient $K_t$ of the wood batch density depending on the hydraulic pressure used. The magnitude of the correction coefficient $K_t$ influences the magnitude of the calculated apparent pulp quantity $M_t$ produced. Due to this, the best possible result is not reached by the method of the Finnish Published Specification No. 64 666, because the best possible result cannot be reached by a regulation based on an incorrect value of $M_t$.

A substantial factor in the method of the invention is thus that when determining the correction coefficient of the wood batch density, i.e. the batch density coefficient, attention is paid to the position of the grinding plate and also to the hydraulic pressure used. The correction coefficient obtained in this way is used when calculating the pulp quantity produced according to the formula (I). The value of this pulp quantity is then compared with the corresponding target value for the pulp quantity produced and, on this basis, the grinding process is regulated in order to reach the target value for the pulp quantity produced, i.e. the target value for the rate of production.

In practice, factors of different kinds effect a change in the level of hydraulic pressure influencing the magnitude of the correction coefficient of the wood batch density. In FIG. 7 for instance, the influence of the stone sharpness on the average level of hydraulic pressure has been shown, in principle, for a constant rate of production. It is seen from FIG. 7 that when the stone gets dull, a constant rate of production needs a higher average level of hydraulic pressure than what is necessary if the stone is sharp. An increase of the rate of production, i.e. of the pulp quantity produced, and thus also an increase of the operating value of the grinder output, also increase the average level of hydraulic pressure. This matter is shown in principle in FIG. 8. The operating value of the speed of the grinding plate also has an increasing effect on the average level of hydraulic pressure. This is shown in FIG. 9. The factors mentioned above shall thus be considered when determining the magnitude of the correction coefficient of the wood batch density.

A possible embodiment of the invention is shown in principle in FIG. 6. In FIG. 6, the movement of the grinding plate 105 of the pocket grinder is controlled by regulating the pressure acting in the hydraulic cylinder of the grinding plate. The advance of the grinding plate 105 during the grinding is measured by a signal obtained from the position of the grinding plate. The measurement can be effected in the same way as described in the Finnish Published Specification No. 64 666 by using pulse sensors 112 measuring the speed of the grinding plate, but also other known methods for measuring the position, advance and speed of the grinding plate can be applied. These pulse sensors can e.g. be of type Litton Servotecknik, G 70 SSTLBI-1000005PX, the Federal Republic of Germany. The hydraulic pressure again is measured from the pressure acting in the hydraulic cylinder of the grinding plate 105 by means of a pressure meter 114. A regulating circuit 116 calculates by means of a separately determined algorithm the sharpness of the batch density curve and thereafter on the basis of the position of the grinding plate the density correction coefficient $K_t$ corresponding to the measuring moment t in question and calculates the apparent pulp quantity $M_t$ produced corresponding to the measuring moment t. In addition, the regulating circuit 116 compares this value $M_t$ with the corresponding target value for the pulp quantity produced. On the basis of the difference between these values and if necessary, on the basis of a separately determined regulating algorithm, the advance of the grinding plate 105 is controlled by means of regulating valve 117 for hydraulic pressure so that the pulp quantity produced during a time unit, i.e. the rate of production, reaches the target value set for it.

The examples described and shown in the drawing are in no way intended to limit the idea of the invention, but only intended to visualize the basic idea of the invention. As to the details, the method according to the invention can vary even considerably within the limits of the claims. Consequently, in the example of FIG. 6, only one pocket is described, but it is evident that the invention also can be applied when the other pockets of the grinder are grinding. It is also evident that the sharpness of the batch density curve influencing the magnitude of the density correction coefficient can be calculated not only on the basis of the level of hydraulic pressure but also on the basis of factors determining the level of hydraulic pressure. Such factors are e.g. the sharpness of the stone, the target value for the pulp quantity produced, i.e. for the rate of production, etc. as described above. The construction of the regulating circuit 116 has not been limited in any way either. The regulating circuit 116 can be realized e.g. by means of a traditional analog technique, but preferably, however, by means of a micro-processor or a computer.

We claim:

1. A method of regulating a grinding process in a pocket grinder comprising the steps of:

pressing a batch of wood in at least one pocket against a rotating grindstone with a grinding plate movable in a grinding stroke in the pocket, the density of the batch of wood being other than constant during the grinding stroke;

calculating at measuring points at predetermined intervals of the grinding stroke of the grinding plate the amount of pulp produced, said calculating being defined by the relationship:

$$M_t = AX_tD_w$$

wherein $M_t$=amount of pulp produced,

A=cross-sectional area of the pocket, $X_t$=distance of movement of the grinding plate during a time period t, and $D_w$=average density of the batch of wood in the pocket during the grinding;

calculating a value of specific energy consumption corresponding to said amount of pulp produced;

comparing the specific energy consumption to a target figure;

so controlling the grinding of the batch of wood in response to a deviation of said specific energy consumption from said target figure that the specific energy consumption remains as constant as possible during an entire grinding stroke of the grinding plate;

determining a correction factor for the density of the batch of wood as a function of the position of said grinding plate and the pressure of said grinding plate therefor; and calculating a corrected amount of pulp produced by multiplying said amount of pulp produced by said correction factor, whereby the value of said specific energy is corrected to control at least one operating parameter of said pocket grinder.

2. A method according to claim 1, wherein the pressure of said grinding plate is hydraulic and an average level of the hydraulic pressure during a grinding stroke is used as the hydraulic pressure in determining the correction factor.

* * * * *